US011692537B2

(12) United States Patent
Dotan et al.

(10) Patent No.: US 11,692,537 B2
(45) Date of Patent: Jul. 4, 2023

(54) METHOD AND SYSTEM FOR DAMPING FLOW PULSATION

(71) Applicant: Comet-ME Ltd., Jerusalem (IL)

(72) Inventors: Noam Dotan, Givat Yeshayahu (IL); Justus Hoffstaedt, Ettlingen (DE); Ryan Melville Whillier Brand, Hubley (CA); Elad Orian, Jerusalem (IL)

(73) Assignee: Comet-ME Ltd., Jerusalem (IL)

( * ) Notice: Subject to any disclaimer, the term of this patent is extended or adjusted under 35 U.S.C. 154(b) by 96 days.

(21) Appl. No.: 17/145,424

(22) Filed: Jan. 11, 2021

(65) Prior Publication Data

US 2022/0220957 A1 Jul. 14, 2022

(51) Int. Cl.

| | |
|---|---|
| ***F04B 39/00*** | (2006.01) |
| ***F04B 49/03*** | (2006.01) |
| ***F04B 53/04*** | (2006.01) |
| ***F04B 49/22*** | (2006.01) |

(52) U.S. Cl.

CPC ..... *F04B 39/0033* (2013.01); *F04B 39/0027* (2013.01); *F04B 39/0038* (2013.01); *F04B 39/0055* (2013.01); *F04B 39/0061* (2013.01); *F04B 49/03* (2013.01); *F04B 49/22* (2013.01); *F04B 53/04* (2013.01); *F04B 2205/13* (2013.01)

(58) Field of Classification Search

CPC ..... F04B 39/0033; F04B 39/0027; F04B 39/0038; F04B 39/0061; F04B 39/0055; F04B 2205/13; F04B 49/03; F04B 49/22; F04B 53/04

See application file for complete search history.

(56) References Cited

U.S. PATENT DOCUMENTS

| | | | | |
|---|---|---|---|---|
| 3,457,864 A * | 7/1969 | Price | F04B 49/022 417/44.2 |
| 3,749,165 A * | 7/1973 | Heaton | E21B 33/03 138/30 |
| 4,445,829 A | 5/1984 | Miller | |
| 6,123,525 A | 9/2000 | Burns | |
| 7,353,845 B2 | 4/2008 | Underwood et al. | |

(Continued)

FOREIGN PATENT DOCUMENTS

| | | |
|---|---|---|
| DE | 202020105133 | 10/2020 |
| GB | 2589860 | 6/2021 |

(Continued)

OTHER PUBLICATIONS

Plast-O-Matic "Introduction to Pulsation Dampeners / Surge Suppressors: Innovative Design Provides Multiple System Safeguards", Plast-O-Matic Valves, Technical Articles, 9 P., 2021.

(Continued)

*Primary Examiner* — Peter J Bertheaud

(57) ABSTRACT

A method of attenuating pressure pulsations, comprises: pumping liquid into a vessel in fluid communication with a flow line by a conduit sealingly passing through a top surface of the vessel, so as to discharge the liquid into the flow line while creating an air-liquid interface in the vessel, by trapping in an upper part of the vessel air that attenuates pressure pulsations caused by the pumping. The method also comprises generating condition for the liquid to drain out of the vessel to allow air to fill at least the upper portion of the vessel.

15 Claims, 8 Drawing Sheets

(56) References Cited

U.S. PATENT DOCUMENTS

| | | | |
|---|---|---|---|
| 7,665,484 | B2 | 2/2010 | Kamada et al. |
| 8,591,464 | B2 | 11/2013 | Kumar et al. |
| 9,777,879 | B2 | 10/2017 | Fujita et al. |
| 2020/0158063 | A1 | 5/2020 | Elder |
| 2020/0362844 | A1 | 11/2020 | Haffenden et al. |

FOREIGN PATENT DOCUMENTS

| | | |
|---|---|---|
| KR | 10-0291161 | 6/2001 |
| KR | 100291161 | 6/2001 |
| RU | 2673922 | 12/2018 |
| WO | WO 2017/050467 | 3/2017 |
| WO | WO 2022/149147 | 7/2022 |

OTHER PUBLICATIONS

International Search Report and the Written Opinion dated Jul. 18, 2022 From the International Searching Authority Re. Application No. PCT/IL2022/050045. (21 Pages).

Invitation to Pay Additional Fees, Communication Relating to the Results of the Partial International Search dated Apr. 11, 2022 From the International Searching Authority Re. Application No. PCT/IL2022/050045. (4 Pages).

* cited by examiner

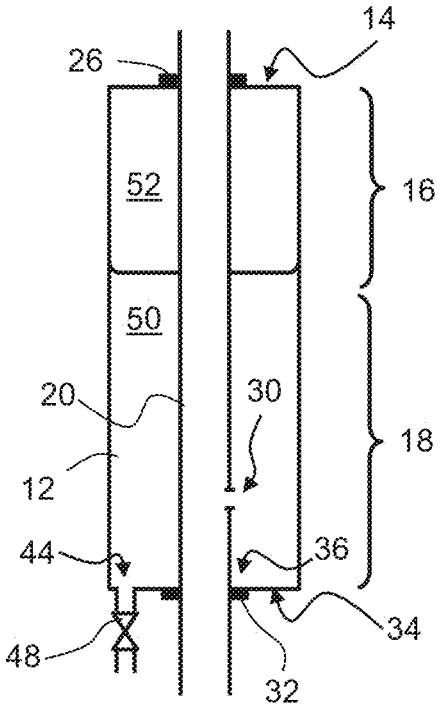
FIG. 2A
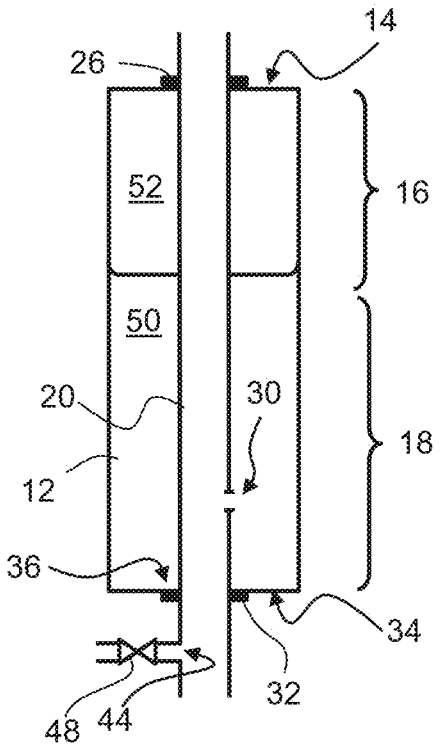
FIG. 2B
FIG. 2C
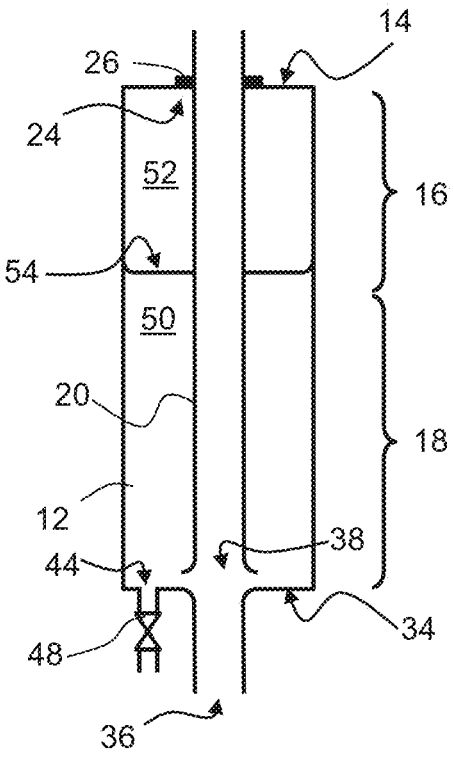

METHOD AND SYSTEM FOR DAMPING FLOW PULSATION

FIELD AND BACKGROUND OF THE INVENTION

The present invention, in some embodiments thereof, relates to flow control and, more particularly, but not exclusively, to a method and system for damping flow pressure pulsation.

Many pumps, particularly pumps of the positive displacement type, generate pressure pulsations. The pressure pulsation occurs when the pump produces a non-constant flow of fluid so that there are periods of times during which the flow is lower and other periods of time during which the flow is higher. For instance, in a piston pump operating by a crank shaft the speed profile of the piston is sinusoidal. Since the flow of the fluid correlates with the piston's speed, the flow varies periodically. This results in pressure variations both in the pump and in the fluid discharge line.

The fluctuations in the fluid pressure can propagate upstream the flow and can therefore induce undesirable effects on the pump, and the fluid line, which undesirable effects include, for example, hammering, high frequency harmonics, resonance, fatigue and damage.

Consequently, attempts have been made to attenuate pressure pulsations, using a bladder separating between the discharged fluid and a pressurized gas (e.g., nitrogen or air). When the pressure of the discharged fluid is high, the pressurized gas absorbs the pressure as elastic energy, and when the pressure of the discharged fluid is low, the elastic energy is transferred back to the discharged fluid, thus reducing the peak-to-peak variations of the pressure of the discharged fluid.

U.S. Pat. No. 7,353,845 discloses an accumulator for downhole operations. A housing connects inline to a hydraulic system, and an elastomeric bladder is disposed internally of the housing and separates a gas compartment from a fluid compartment. The accumulator includes an anti-extrusion device that assumes one of two positions to either prevent extrusion of the bladder into the hydraulic system, or to open fluid communication between the fluid compartment and the hydraulic system. U.S. Pat. No. 7,665,484 discloses a fluid coupling pulsation damper for fuel pumps in fuel engines. The pulsation damper consists of closed cell filled with pressurized gas that can deform according to the fluid pressure around it. U.S. Pat. No. 9,777,879 discloses a closed cell with flexible walls that is filled with a gas and may contract and expand to absorb the fluid pulsation around it. U.S. Pat. No. 10,125,583 discloses a borehole pump assembly operable in association with a windmill. The assembly includes a pump and an air chamber which provides hydraulic shock absorption between the pump and a delivery pipeline. The air chamber is provided with a partially conical diaphragm. The air chamber housing and the pump housing are larger in diameter than a riser pipe receiving liquid from the pump.

Additional background art includes www(dot)plastomatic(dot)com/technical-article/introduction-to-pulsation-dampeners-surge-suppressors/, and www(dot)ramuni-versal(dot)co(dot)uk/uploads/files/p1ckff1d3ofk51u992v8no1cocf.pdf.

SUMMARY OF THE INVENTION

According to an aspect of some embodiments of the present invention there is provided a method of attenuating pressure pulsations. The method comprises: pumping liquid by a pump into a vessel in fluid communication with a flow line by a conduit sealingly passing through a top surface of the vessel, so as to discharge the liquid into the flow line while creating an air-liquid interface in the vessel, by trapping in an upper part of the vessel air that attenuates pressure pulsations caused by the pumping; and generating condition for the liquid to drain out of the vessel to allow air to fill at least the upper portion of the vessel.

According to some embodiments of the invention the vessel is above the pump.

According to some embodiments of the invention the pumping is directly into the conduit, and wherein the conduit has an opening at a lower part of the vessel for releasing the liquid to the lower part.

According to some embodiments of the invention the conduit has a drain opening also outside the vessel, and the liquid is drained through the drain opening.

According to some embodiments of the invention the pumping is directly into the vessel, and wherein the conduit has an inlet at a lower part of the vessel for receiving the liquid from the lower part and directing the liquid to the flow line.

According to some embodiments of the invention the vessel comprises a drain opening at the lower part, and the liquid is drained through the drain opening at the lower part.

According to some embodiments of the invention the drain opening at the lower part is open at all times.

According to some embodiments of the invention the condition for draining are generated by temporarily ceasing the pumping.

According to some embodiments of the invention the condition for draining are generated by operating a valve to open the drain opening at the lower part.

According to some embodiments of the invention the pump comprises a drain opening formed on an encapsulation of the pump, and the liquid is drained through the drain opening on the encapsulation.

According to some embodiments of the invention the drain opening on the on the encapsulation of the pump is open at all times.

According to some embodiments of the invention the condition for draining are generated by operating a valve to open the drain opening on the encapsulation of the pump.

According to an aspect of some embodiments of the present invention there is provided a system for attenuating pressure pulsations. The system comprises: a vessel having a top surface, an upper part and a lower part; a conduit in fluid communication with the lower part, the conduit sealingly passing through the top surface to feed a flow line outside the vessel with liquid; a liquid inlet formed in the vessel for receiving the liquid from a pump in a manner that the liquid enters both the vessel and the conduit, and creates an air-liquid interface in the vessel, by trapping in the upper part air that attenuates pressure pulsations generated by the pump; and at least one drain opening constituted to drain the liquid out of the vessel and to allow air to fill at least the upper portion of the vessel.

According to some embodiments of the invention the conduit sealingly passes through the liquid inlet to connect directly to an outlet of the pump, wherein the conduit has an opening at a lower part of the vessel for releasing the liquid to the lower part.

According to some embodiments of the invention at least one of the drain opening(s) is formed on the conduit outside the vessel.

According to some embodiments of the invention the conduit is disconnected from the liquid inlet of the vessel, and comprises a conduit inlet at the lower part for receiving the liquid from the lower part and directing the liquid to the flow line.

According to some embodiments of the invention at least one of the drain opening(s) is formed in the vessel at the lower part.

According to some embodiments of the invention the vessel is devoid of any partition at the air-liquid interface.

According to an aspect of some embodiments of the present invention there is provided a pump system. The pump system comprises the system as delineated above and optionally and preferably as further detailed below, and a pump having an outlet connected to the liquid inlet.

According to some embodiments of the invention the pump system comprises a controller for temporarily ceasing operation of the pump.

According to some embodiments of the invention the controller is configured for opening the valve when the pump is not in operation, and closing the valve when the pump is in operation.

According to some embodiments of the invention the system comprises a passive valve at the drain opening, constituted to assume an opened state when the pump is not in operation, and a closed state when the pump is in operation.

According to some embodiments of the invention a volume of the vessel is at least $(ps+\Delta p)\times V_r\times p_s/(\Delta p\times p_{atm})$, wherein $p_s$ is an expected static pressure at an outlet of the pump, $p_{atm}$ is an expected atmospheric pressure outside the vessel, and $V_r$ and the $\Delta p$ are predetermined volume and pressure tolerance parameters.

According to some embodiments of the invention the draining is over a draining period of from about 1 hour to about 10 hours.

According to some embodiments of the invention the pump is a positive displacement pump. According to some embodiments of the invention the positive displacement pump is a reciprocating pump. According to some embodiments of the invention the positive displacement pump is a double action pump. According to some embodiments of the invention the positive displacement pump is a rotary pump. According to some embodiments of the invention the pump is a centrifugal pump. According to some embodiments of the invention the pump is a borehole pump.

According to an aspect of some embodiments of the present invention there is provided a valve device. The valve device comprises: a valve body formed with an opening; a peripheral sealing member positioned within the valve body and being movable towards and away from the opening; and two liquid ports formed at opposite sides of the valve body, and being sealingly connectable to liquid conduits; wherein the peripheral sealing member is positioned and configured such that inflow of liquid through the first port biases the sealing member against the opening, and inflow of liquid through the first port releases the sealing member from the opening.

According to some embodiments of the invention the peripheral sealing member comprises a sealing ring. According to some embodiments of the invention the peripheral sealing member comprises a thermoplastic. According to some embodiments of the invention the thermoplastic is a polyoxymethylene.

According to an aspect of some embodiments of the present invention there is provided a pump system. The pump system comprises: an encapsulation formed with an inlet port for suctioning liquid, an outlet port for delivering the liquid to a flow line, and a drain opening for draining liquid out of the encapsulation when the pump system is not operating; and a pump mechanism for generating the suction at the inlet port and pressurize the liquid through the outlet port.

According to some embodiments of the invention the outlet port and the drain opening are at the same side of the encapsulation.

According to some embodiments of the invention the system comprises a valve at the drain opening of the encapsulation. According to some embodiments of the invention the valve is a controllable valve. According to some embodiments of the invention the valve is a passive valve.

According to some embodiments of the invention the drain opening of the encapsulation is open at all times.

According to some embodiments of the invention the system is other than a centrifugal pump system.

According to an aspect of some embodiments of the present invention there is provided a pump system. The pump system comprises: a pump having an inlet port for generating an inflow of liquid, and an outlet port for generating an outflow of the liquid, wherein the inlet is configured to also allow a backflow of the liquid out of the pump when the pump is not operating; an air vessel, being devoid of any partition and having an interior in fluid communication with the outlet of the pump; and a conduit, sealingly passing through a top surface of the vessel to establish fluid communication between the interior of the vessel and the atmosphere. According to some embodiments of the invention the system is a centrifugal pump system.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings:

FIGS. 2A-C are schematic illustrations showing various optional locations for a drain opening, according to some embodiments of the present invention;

FIG. 7A shows results obtained without attenuation of pressure pulsation, and FIG. 7B shows results obtained with attenuation of pressure pulsation;

DESCRIPTION OF SPECIFIC EMBODIMENTS OF THE INVENTION

Figure 1A:
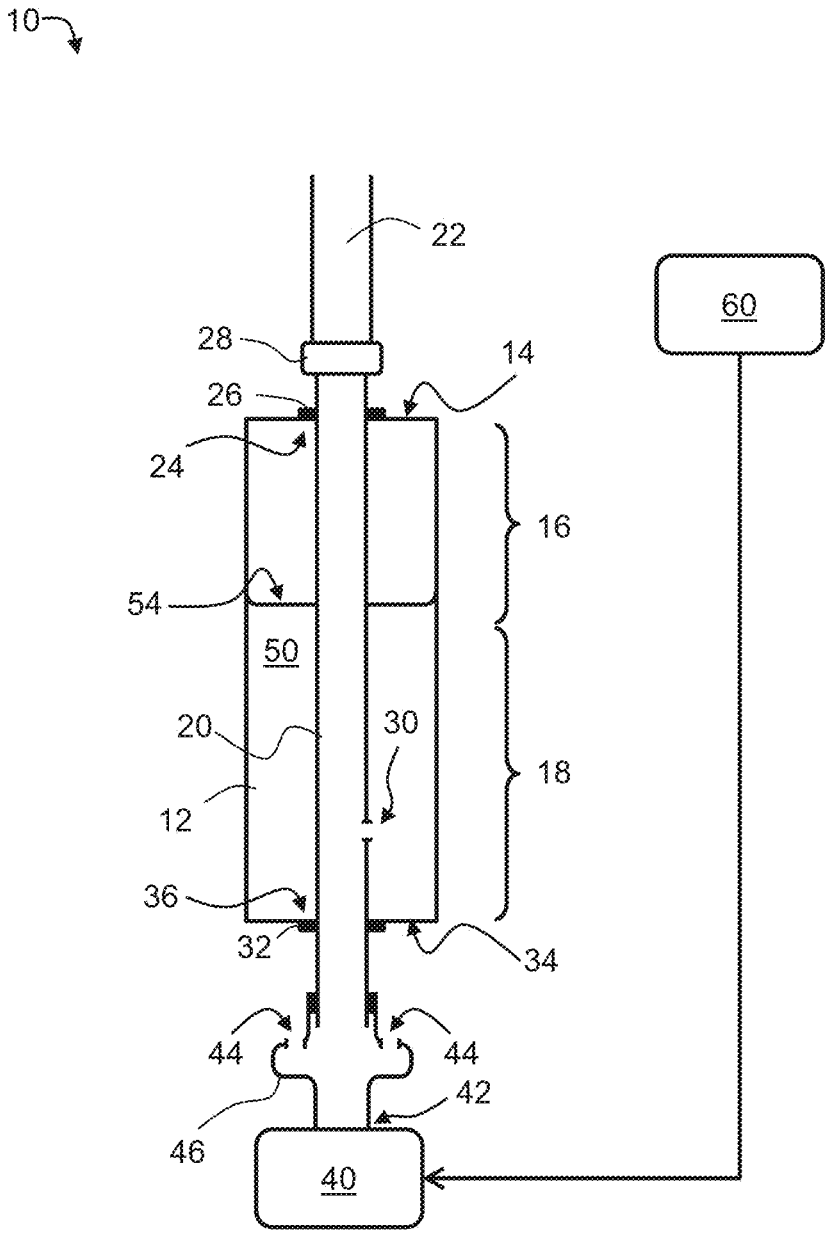
FIGS. 1A-B are schematic illustrations of a system for attenuating pressure pulsations, according to some embodiments of the present invention.

The present invention, in some embodiments thereof, relates to flow control and, more particularly, but not exclusively, to a method and system for damping flow pressure pulsation.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The Inventors found that existing designs for attenuation of pressure pulsation in water lines are disadvantageous since they require service, whereby due to gas leaks, there is a need to fill pressurized gas from time to time. This is particularly difficult when the pulsation damper is not easily accessible, for example, in situation in which the damper is near a pump that is submerged in a borehole well under the ground. The Inventors found that existing designs for attenuation of pulsation in water lines are disadvantageous also because these designs require adjustment of the gas pressure according to the liquid pressure. This is particularly disadvantageous in situation in which the damper is used to attenuate pulsation caused by a pump that is submerged in a borehole well under the ground, because due to seasonal or other changes in the water level in the borehole the pressure varies with time, and so adjustment of the gas pressure is required repeatedly.

While conceiving the present invention it has been hypothesized and while reducing the present invention to practice it has been realized that attenuation of pulsation can be improved by creating an air-liquid interface in a vessel. This allows refilling the vessel with air by draining the liquid out of the vessel, without accessing the vessel.

Figure 1B:
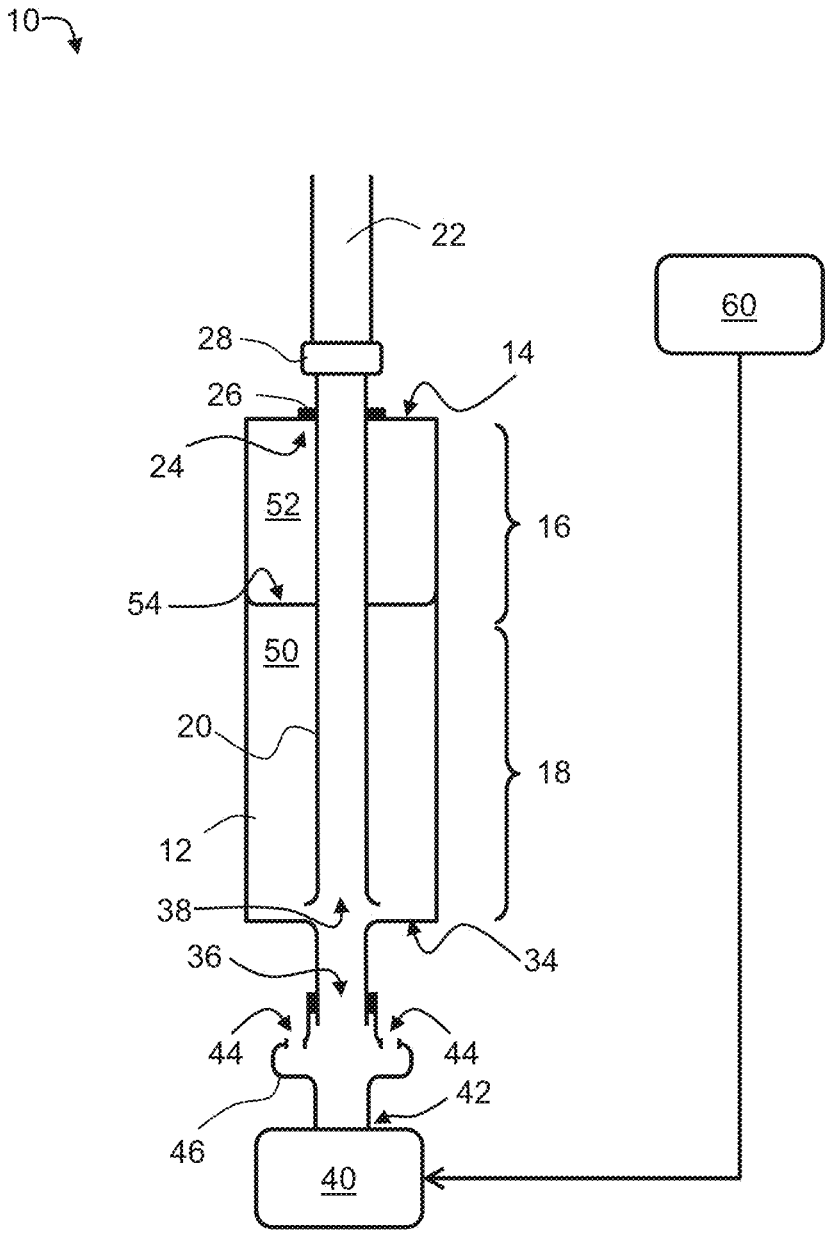

Referring now to the drawings, FIGS. 1A and 1B illustrate a system 10 for attenuating pressure pulsations, according to some embodiments of the present invention. System 10 comprises a vessel 12 having a top surface 14, a bottom surface 34, an upper part 16 and a lower part 18. Vessel 12 is preferably rigid and can be made of any material that is non-permeable to liquid and gas, e.g., to water and air. For example, vessel 12 can be made of polyvinyl chloride, stainless steel, or the like. The bottom part of vessel is formed with an inlet opening 36 for receiving liquid 50 (e.g., water) from a pump 40. Vessel 12 is preferably above pump 40. System 10 is preferably positioned in close proximity to as possible to pump 40.

System 10 also comprises a conduit 20 in fluid communication with the lower part 18 of vessel 12. Conduit 20 sealingly passes through conduit-receiving opening 24 in top surface 14 of vessel 12. For example, conduit 20 can be fitted into opening 24 by means of a gasket 26 or bonding or the like, which resiliently supports conduit 20 in opening 24 and provides a leak-proof seal between the surface of opening 24 and the outer surface of conduit 20. Conduit 20 serves for feeding a flow line 22 outside vessel 12 with liquid 50. A pipe connector 28 provides a fluid connection between conduit 20 and flow line 22.

The fluid communication between conduit 20 and lower part 18 can be achieved in more than one way.

In some embodiments, illustrated in FIG. 1A, conduit 20 has one or more openings 30 at the section of conduit 20 which occupies the lower part 18 of vessel 12. In these embodiments, inlet opening 36 serves as a conduit-receiving opening and conduit 20 sealingly extends through opening 36, for receiving the liquid pumped out of pump 40 through its outlet 42. A leak-proof seal between the surface of opening 36 and the outer surface of conduit 20, can be provided, for example, by bonding or by means of an additional gasket 32 which can be of the same type and function as gasket 26 described above.

In some embodiments, illustrated in FIG. 1B, conduit 20 is mounted in proximity, but does not sealingly connect, to inlet opening 36 of vessel 12, such that there is a non-sealed fluid communication between inlet opening 36 of vessel 12 and a conduit inlet 38 of conduit 20. Typically, conduit 20 is open at its bottom end, whereby the conduit inlet 38 is the open end of conduit 20. Preferably, as illustrated in FIG. 1B, the open end 38 of conduit 20 has an outwardly-flared shape so as to reduce flow losses at the interface between inlet 36 of vessel 12 and open end 38 of conduit 20.

In any of the configurations, the liquid 50 fills the lower part 18 of vessel 12. In the configuration illustrated in FIG. 1A, liquid 50 enters vessel 12 via the opening(s) 30 at the section of conduit 20 which occupies the lower part 18 of vessel 12. Thus, in this configuration, the liquid 50 enters conduit 20 before filling the lower part 18 of vessel 12. In the configuration illustrated in FIG. 1B, the non-sealed fluid communication between inlet opening 36 of vessel 12 and conduit inlet 38 of conduit 20 is utilized for filling the lower part 18 of vessel 12, whereby liquid 50 enters the lower part 18 of vessel 12 through the gap between the inlet 36 of vessel 12 and the conduit inlet 38 of conduit 20. Thus, in this configuration, liquid 50 from pump 40 enters the lower part 18 of vessel 12 before entering conduit 20.

The top surface 14 and the side walls of the upper part 16 are sealed, so that the sealed engagement between conduit 20 and conduit-receiving opening 24 ensures that air 52 is trapped in the upper part 16 of vessel 12 when liquid 50 fills the lower part 18. This creates an air-liquid interface 54 in vessel 12. During parts of the pumping cycle at which the pressure generated by pump 40 is increased, the pressure in vessel 12 is increased, causing the air to compress, and interface 54 is shifted upwards. During parts of the pumping cycle at which the pressure generated by pump 40 is decreased, the opposite occurs. The pressure above interface 54 is higher than the pressure below interface 54, interface 54 is shifted downwards and air 52 is decompressed. Thus, air 52 absorbs mechanical energy from the liquid when the pressure is increased, and releases mechanical energy to the liquid when the pressure is decreased. This reduces the peak-to-peak amplitude of the pressure, and therefore effectively attenuates the pressure pulsations at the lower part 18 of vessel 12. Since conduit 20 is in fluid communication with the lower part 18, the trapped air 52 also attenuates the pressure pulsations in conduit 20 and flow line 22.

Based on a desired, and predetermined, volume parameter $V_r$ that represents the maximal volume change of air 52 during compression, and based on a desired, and predetermined, pressure tolerance parameter $\Delta p$ that represents the peak-to-peak pressure difference after the attenuation, the volume of vessel 12 can be selected for a given expected static pressure $p_s$ at outlet 42 of pump 40. In these embodiments, the volume of vessel 12 can be at least $(p_s+\Delta p)\times V_r\times p_s/(\Delta p\times p_{atm})$, where $p_{atm}$ is the expected atmospheric pressure outside vessel 12 (e.g., 1 atmosphere).

In various exemplary embodiments of the invention system 10 is devoid of any partition at air-liquid interface 54. This is advantageous over traditional pulsation dampers, since it eliminates the need to perform maintenance operations on such partition. Another advantage is that it ensures that the pressure at lower part 18 is the same as the pressure at upper part 16, and does not require maintaining a different pressure of the air at upper part 16.

System 10 optionally and preferably also comprises one or more drain openings 44 to drain liquid 50 out of vessel 12. Preferably, drain openings 44 are positioned to facilitate draining solely by the gravitational force. The drain openings 44 can be formed on the vessel, for example, at the bottom surface 34, on conduit 20 itself, below the conduit-receiving opening 36 of vessel 12, on a dedicated valve 46 connected between vessel 12 and pump 40, or it can be formed on the encapsulation of pump 40 itself. Combinations of these embodiments, whereby openings 44 are formed on more than one of these components are also contemplated. FIGS. 1A and 1B schematically illustrate configurations in which a drain opening 44 is formed on a dedicated valve 46. Configurations in which a drain opening 44 is formed on the vessel 12 are schematically illustrated in FIGS. 2A and 2C, a configuration in which a drain opening 44 is formed on the conduit 20 is schematically illustrated in FIG. 2B, and a configuration in which a drain opening 44 is formed on the encapsulation of pump 40 is schematically illustrated in FIGS. 8A-C and 9A-B.

In some embodiments of the present invention, pump 40 allows backflow of the liquid through its inlet port when pump 40 is not operative. In these embodiments, there is no need for system 10 to include drain opening 44, because the draining can be via the inlet port of pump 40, which can serves as a draining opening when pump 40 is not operating.

The size of drain openings 44 is preferably selected so as to ensure that vessel 12 is completely drained over a draining period of from about 1 hour to about 10 hours.

In use of system 10, the draining of liquid 50 out of vessel 12 typically empties vessel 12 from 50 during periods of time at which pump 40 is not operating (e.g., at times at which flow line is not required to deliver liquid). This allows more air to fill at least the upper portion 16 of vessel 12. This is advantageous over traditional pulsation dampers because it does not require pressurizing the air into the damper. Rather, it only requires generating conditions for vessel 12 to be drained out of liquid 50. An additional advantage of the present embodiments is that emptying vessel 12 allows an easier start of the pump, since it does not have to start under full load of hydrostatic pressure on flow line 22.

The air preferably enters vessel 12 from above through flow line 22. In the latter embodiments, at least during the draining stage, the flow line 22 is open to the atmosphere, or is connected to a fluidic system that is open to the atmosphere. For example, when pump 40 is used to fill a liquid tank (not shown, see FIGS. 4, 9A and 9B, tank 116), flow line 22 can be an open ended at an end that is distal from system 10. In this case, when vessel 12 is drained, air enters into flow line 22 through its open end, and than flows into vessel 12. Flow line 22 can be an open ended at all times, or it can be provided with a valve or a tap (not shown, see FIGS. 4, 9A and 9B, tap 118). When flow line 22 is provided with a valve or a tap, the valve or tap is opened automatically or manually during the draining stage.

When drain opening 44 is formed on a dedicated valve 46 connected between vessel 12 and pump 40 (FIGS. 1A and 1B), the draining through drain opening 44 is controlled by valve 46. When drain opening 44 is formed on vessel 12 or conduit 20 it can remain open at all times, or alternatively be controlled by a valve 48 mounted at opening 44. Any of valves 44 and 46 can be controllable valves, such as, but not limited to, a solenoid valve or a servo valve. In these embodiments, the respective valves and pump 40 are optionally and preferably controlled by the circuit of the same controller 60 (not shown in FIGS. 2A-C, see FIGS. 1A and 1B), which can be mounted on pump 40 or, more preferably, remote from pump 40. The circuit of controller 60 can be configured to open the respective valve when the operation of pump 40 is temporarily ceased, thereby synchronizing between the draining of vessel 12 and the operation of pump 40.

Figure 3A:
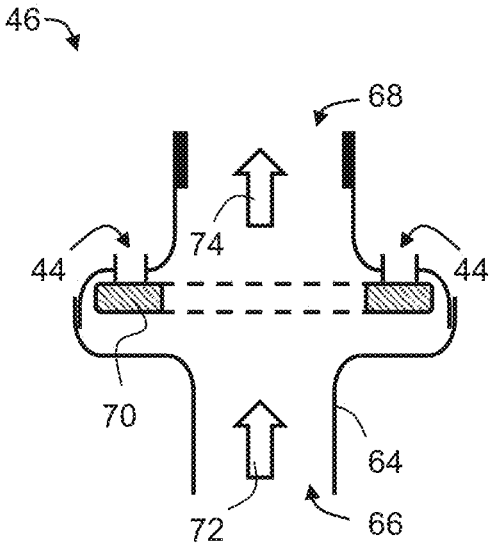
FIGS. 3A-B are schematic illustrations of a passive valve according to some embodiments of the present invention.
Figure 3B:
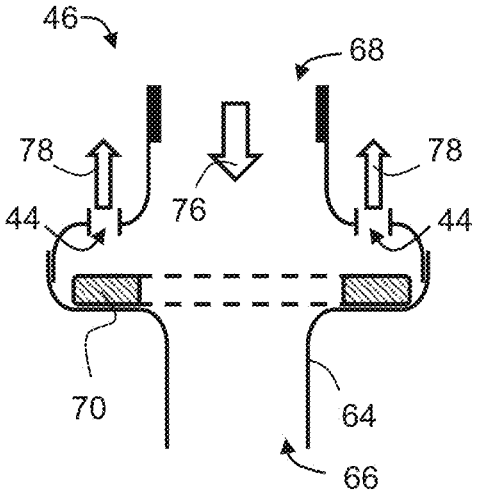

In some embodiments of the present invention the valve that controls the drain opening 44 is a passive valve. A representative example of a passive valve suitable for the present embodiments is illustrated in FIGS. 3A and 3B. The illustration and description below are for the case in which valve 46 is connected between the vessel and the pump (both not shown in FIGS. 3A and 3B, see FIGS. 1A and 1B), but similar principles can be employed, mutatis mutandis, for making valve 48 also passive. Valve 46 comprises a valve body 64, a first port 66, a second port 68, opposite to the first port 66, and a movable peripheral sealing member 70, such as, but not limited to, a sealing ring. Sealing member can be made, for example, of a thermoplastic, such as, but not limited to, polyoxymethylene. Drain opening(s) are formed on body 64, facing away from the inlet 66.

FIG. 3A illustrates a closed state of valve 46. When pump 40 is in operation, liquid from pump 40 fills port 66, and flows into body 64. This inflow is represented by block arrow 72. The liquid flow biases (pushes member 70 upward) member 70 against drain opening 44 thereby at least partially preventing the liquid from leaking out of opening 44. As the pump 40 continues pumping more liquid into body 64, the flow of liquid continues through the central portion of member 70, and exits through second port 68, which serves as an outlet for feeding vessel 12 (FIG. 1B) or conduit 20 (FIG. 1A) with the liquid. This continued flow is represented by block arrow 74. FIG. 3B illustrates an opened state of valve 46. When the operation of the pump is temporarily ceased, there is no inflow into port 66 and there is no bias on member 70 against drain opening 44. Member 70 thus falls back by the gravitational force. Design considerations for on member 70 are provided in the Examples section that follows. The liquid thus begins to flow backwards into second port 68, which now functions as the inlet of valve 46. This backward flow is represented by block arrow 76. Since the pump is still connected to valve 46, first port 66 is still filled with liquid, the liquid flows out of drain opening(s) 44. This flow is represented by block arrows 78. The flow out of drain opening(s) 44 continues as long as pump 40 is not in operation, or until vessel 12 is drained. Thus, valves 46 of the present embodiments toggles between a closed state when the pump is not in operation and an opened state when the pump is in operation, without being energized by any mechanism except the liquid flow itself.

It is appreciated that the closed state of valve 46 need not provide hermetic seal, because even in the case of a partial seal the pump can still generate flow into vessel 12 and conduit 20, except that a portion of the liquid pumped by the pump, which is typically a small portion, for example, less than 10% or less than 5% of the flow rate generated by the pump, exits through opening 44.

The present embodiments, as stated, also contemplate configurations in which drain opening 44 remains open at all times. In these embodiments the size of drain opening 44 is selected to ensure that the flow rate entering system 10 from pump 40 is substantially higher (e.g., at least 10 times or at least 10 times or at least 50 times or at least 100 times higher) than the flow rate of liquid exiting from system 10 through drain opening 44. A representative example of a procedure for determining the size of opening 44 is provided in the Examples section that follows.

Figure 8A:
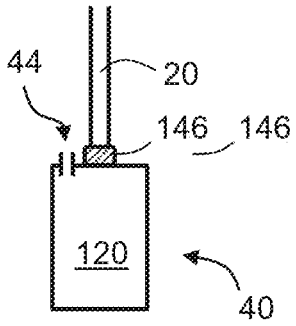
FIGS. 8A-C are schematic illustrations of configurations in which a drain opening is formed on an encapsulation of a pump 40.
Figure 8B:
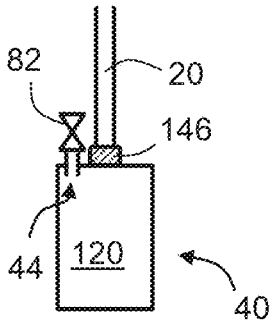
Figure 8C:
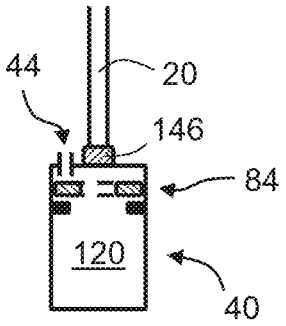

As stated, when pump 40 allows backflow of liquid through its inlet port during the time period at which pump 40 is not operative, the inlet port of pump 40 can serve as a draining opening. This is a typical situation when pump 40 is, for example, a centrifugal pump. In embodiments of the invention in which pump 40 does not allow the liquid to leak out of its inlet port, and in which it is desired the draining to be executed through pump 40, pump 40 is provided with drain opening 44. Representative examples of such configurations are shown in FIGS. 8A-C which are schematic illustrations of embodiments in which drain opening 44 is formed on the encapsulation 120 of pump 40. Shown in FIGS. 8A-C are pump 40 connected to a liquid line, which can be for example, conduit 20, by means of a connector 146. Drain opening 44 is preferably formed on the upper surface of the encapsulation 120. When pump 40 is not operating, the gravitational force generated in conduit 20 flow of liquid from vessel 12 (not shown) downwards into encapsulation 120. This results in an overflow through drain opening 44, allowing more liquid to flow downwards into encapsulation 120, and ensuring drainage of vessel 12. In embodiments in which the fluid line 22 is open ended during the darning stage, the air enters into vessel 12 during the overflow in encapsulation 120. When drain opening 44 is formed on the encapsulation 120 of pump 40, it can remain open at all times, as illustrated in FIG. 8A, it can be controlled by a controllable valve 82 as illustrated in FIG. 8B, or it can be controlled by a passive valve 84 as illustrated in FIG. 8C. The principles and operations of valve 82 can be the same as those described above with respect to valve 48, and the principles and operations of valve 84 can be the same as those described above with respect to valve 46.

System 10 of the present embodiments can be employed to attenuate pressure pulsations generated by many types of pumps, including. In some embodiments of the present invention pump 40 is a positive displacement pump. Representative examples of positive displacement pump suitable for the present embodiments include, without limitation, reciprocating pumps (e.g., plunger pumps, piston pumps, diaphragm pumps, circumferential piston pumps), double action pumps, rotary pumps (e.g., gear pumps, screw pumps, rotary vanes, peristaltic pumps.). Also contemplated for use with system 10 are centrifugal pumps. In various exemplary embodiments of the invention pump 40 is a borehole pump.

It is expected that during the life of a patent maturing from this application many relevant pumps will be developed and the scope of the term pump is intended to include all such new technologies a priori.

Figure 4:
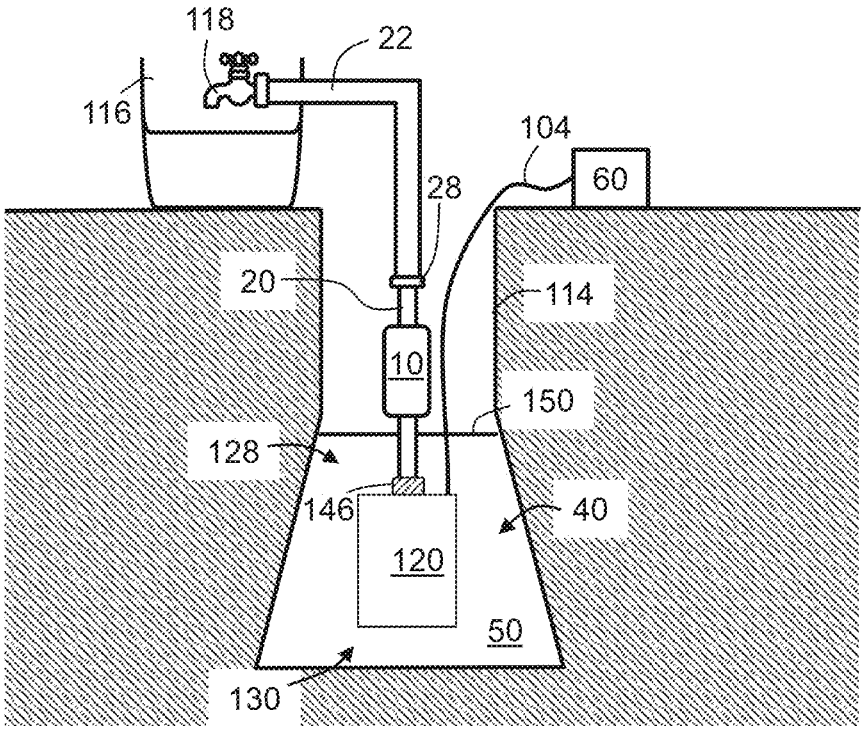
FIG. 4 is a schematic illustration of a deployment of a system in embodiments in which a borehole pump is employed.

Reference is now made to FIG. 4 which is a schematic illustration of a deployment of system 10 with pump 40 in embodiments in which pump 40 is a borehole pump. System 10 and pump 40 can be deployed, for example, within a well 114 (e.g., an aquifer well), the shape of well 114 can include a wider section at its lower part, as illustrated in FIG. 4, or it can have a non-tapered, typically cylindrical, shape. Pump 40 serves for pumping liquid 50 (e.g., water) from well 114 into flow line 22. From flow line pipe 22 the pumped liquid is delivered to a consumer or a consumer system (a liquid tank 116, in the present example). Pump 40 preferably comprises a tubular encapsulation 120 having a proximal end 128 and a distal end 130. When pump 40 is deployed within well 114, proximal end 128 is connected to system 10 (e.g., via a connector 146) and distal end 130 is at a depth level that is below the depth level of proximal end 128. In use, at least distal end 130, but more preferably both ends 128 and 130, are submerged under the level 150 of liquid 50. Tubular encapsulation 120 can be made of any material that may be used under water without affecting both the water quality, and the encapsulation itself, such as, but not limited to, PVC, stainless steel and the like. Pump 40 can connect to system 10 according to any of the aforementioned configurations, which, for clarity of presentation, are not shown in FIG. 4. Specifically, pump 40 can connect directly, or via valve 46, to conduit 20 (see, e.g., FIG. 1A) or to the inlet 36 of vessel 12 (see, e.g., FIG. 1B). System 10 is preferably positioned above the level 150 of liquid 50.

In configurations in which drain opening 44 is formed on vessel 12, on conduit 20, or on dedicated valve 46, system 10 is preferably deployed such that drain opening 44 is above liquid level 150. In configurations in which drain opening 44 is formed on encapsulation 120 of pump 120, drain opening 44 can be below liquid level 150, as will now be explained with reference to FIGS. 9A and 9B.

Figure 9A:
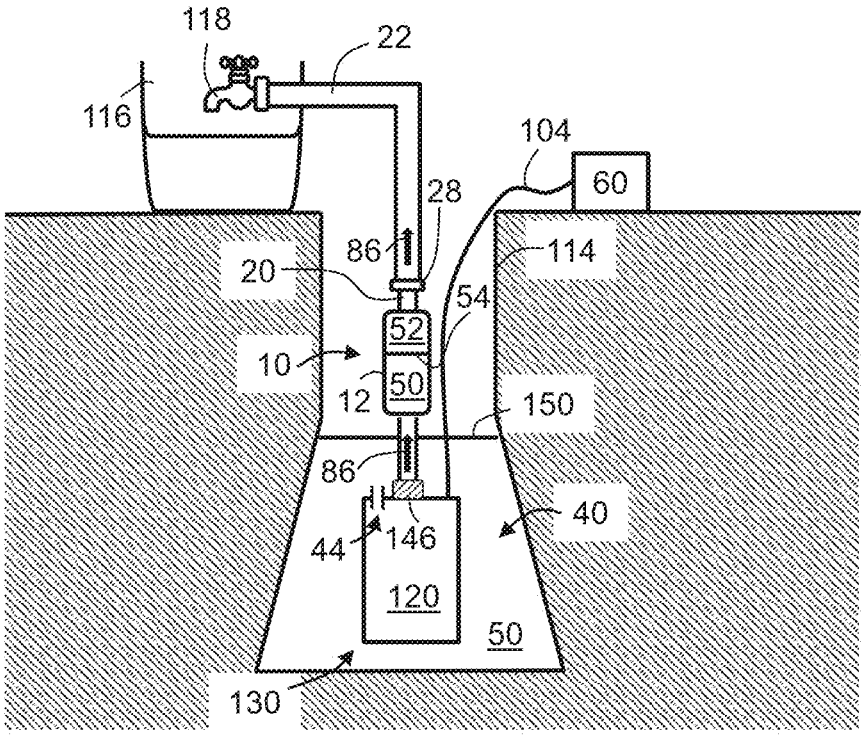
FIGS. 9A-B are schematic illustrations describing flow of liquid during a stage in which the pump is in operation (FIG. 9A), and during a stage in which the pump is not in operation (FIG. 9B).

FIG. 9A illustrates a stage at which pump 40 is in operation. Liquid flows upwards from pump 40 into vessel 12 and conduit 20, the air-liquid interface 54 is formed in vessel 12, and the pressure pulsation is attenuated by the air 52. The liquid continues to flow through conduit 20 into the liquid line 22. From liquid line 22 the liquid is delivered, at attenuated pressure pulsations, to the consumer or a consumer system (e.g., liquid tank 116). When drain opening 44 is open at all times, some liquid may also flow out of pump 40 through drain opening 44 due to the pressure generated by pump 40. Thus, in these embodiments, the diameter of drain opening 44 is smaller (e.g., at least 2 times smaller or at least 4 times smaller or at least 8 times smaller) than the internal diameter of connector 146. When the flow out of drain opening 44 is controlled by controllable valve 82 (see FIG. 8B) this valve is controlled to its closed state during this stage. When the flow out of drain opening 44 is controlled by passive valve 84 (see FIG. 8C), the valves assumes its closed state since its sealing member is biased onto the drain opening by the pump-generated flow.

Figure 9B:
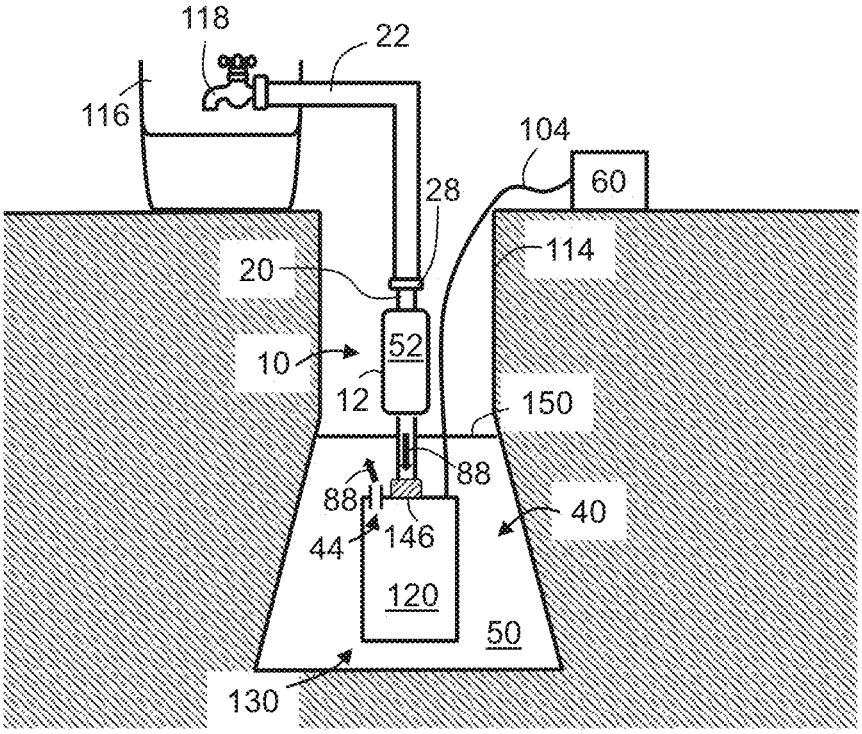

FIG. 9B illustrates a stage at which pump 40 is not in operation. The liquid flows downwards from vessel 12 back into pump 40, exits through drain opening 44, and vessel 12 is emptied. During the backflow of the liquid, more air enters through the open end of liquid line 22 and flow through liquid line 22 and conduit 20 into vessel 12. When flow line 22 is provided with a valve or a tap, the valve or tap is opened automatically or manually during this stage. When the flow out of drain opening 44 is controlled by controllable valve 82 (see FIG. 8B) this valve is controlled to its opened state during this stage. When the flow out of drain opening 44 is controlled by passive valve 84 (see FIG. 8C), the valves assumes its opened state since its sealing member is no longer biased by the pump-generated flow.

Pump 40 is particularly useful for pumping liquid 50 from wells having a borehole diameter of from about 9 cm to about 25 cm, or from about 10 cm to about 20 cm (approximately equivalent to a borehole diameter of from about 4 inches to about 8 inches). In these preferred embodiments, tubular encapsulation 120 has a diameter from about 8 cm to about 24 cm, or from about 8 cm to about 19 cm, so as to fit into wells having such borehole diameters.

Preferably, pump system is a double action reciprocating pump system. In experiments performed by the present inventors, a double action reciprocating pump system constructed according to the teachings described herein was able to provide more than 3 cubic meters per hour, at pump head of about 30 meters.

A representative example of a borehole pump suitable according to some embodiments of the present invention is described in U.S. Pat. No. 10,753,355, the contents of which are hereby incorporated by reference.

Controller 60, which may be part of system 10 or pump 40 or a system combining system 10 and pump 40, is shown external to encapsulation 120, but need not necessarily be the case, since in some embodiments of the present invention controller is encapsulated within encapsulation 120. Control electrical lines can be connected to one or more components of pump 40 (e.g., to an electrical motor thereof). In embodiments in which controllable valves are employed by system 10, control electrical lines can be connected to the controllable valves for synchronizing the opening and closing of these valves with the operation of pump 40. Control electrical lines are all collectively represented in FIG. 4 by line 104.

The circuit of controller 60 is configured to control the operations of one or more pumps 40. In particular, the circuit of controller 60 is preferably configured for temporarily ceasing the operation of pump 40. The temporary cessation of the operation can be automatically, e.g., according to a predetermined timing protocol (for example, temporary cessation during night hours), or in response to user input. When system 10 does not include controllable valves, the temporary cessation of the pump's operation by itself generates the condition for vessel 12 to drain out the liquid 50 either via a passive valve (e.g., valve 46, see FIGS. 3A and 3B), or, when drain opening 44 is opened at all time, by the continuous leak of liquid through drain opening 44 and the absence of liquid inflow into vessel 12.

As used herein the term "about" refers to ±10%

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Various embodiments and aspects of the present invention as delineated hereinabove and as claimed in the claims section below find experimental support in the following examples.

EXAMPLES

Reference is now made to the following examples, which together with the above descriptions illustrate some embodiments of the invention in a non-limiting fashion.

Example 1

Design Considerations

Pressure Variations and Air Volume

Figure 5:
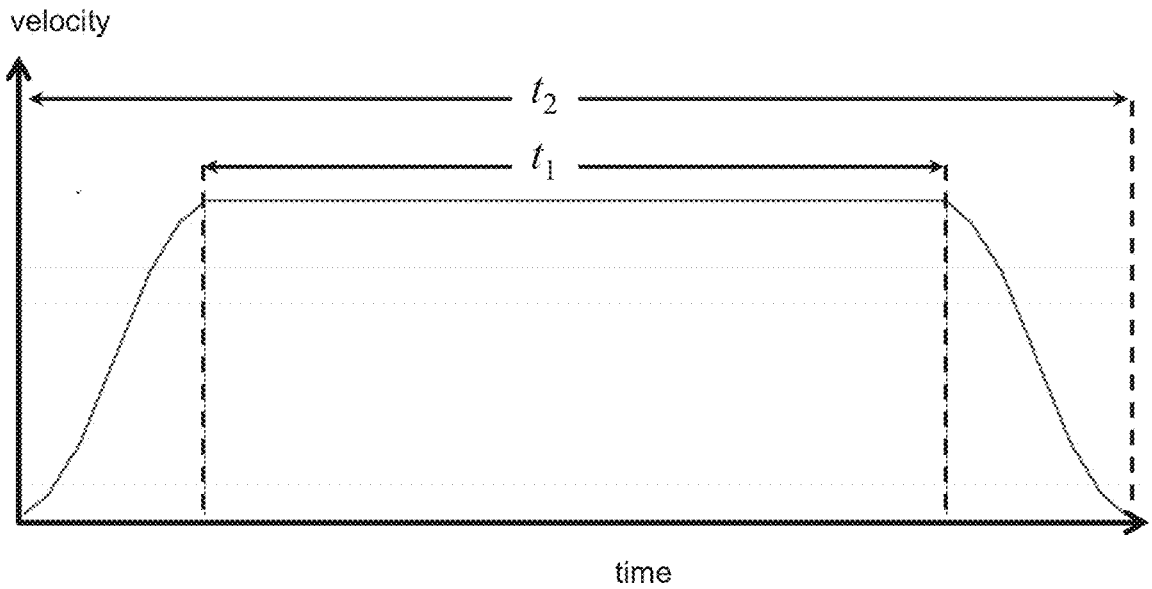
FIG. 5 is a graph which exemplifies a velocity of a piston of a piston pump, in experiments performed obtained according to some embodiments of the present invention.

In positive displacement pumps, the pressure variations in the flow line depends on the pump's duty cycle. The duty cycle is defined as the ratio between the time periods during which the pump delivers water to the flow line at lower rate and at maximum rate. For instance, in a simple plunger or piston pump, the duty cycle is defined as 1−(acceleration time)/(de-acceleration time) or 1−(dead time)/(full stroke time), where the dead time is the time the piston halts at the end of the stroke before it changes the stroke direction. A representative Example of a graph describing the velocity of a piston of a piston pump is shown in FIG. 5. The pump's duty cycle in this case can be expressed as $t_1/t_2$. Typical values for the duty cycle in plunger and piston pumps are from about 0.7 to about 0.9. Higher values for the duty cycle correspond to less expected pressure pulsation.

The volume change of the trapped air in vessel 12 depends inter alia on the duty cycle. Specifically, the rate at which the volume of air in vessel 12 varies can be estimated as $V_S \cdot (1-T)$, where $V_S$ is the stroke volume of the pump and T is its duty cycle. For example, when the full stroke volume of a pump 40 is about 100 ml, and its duty cycle is about 0.7, a rough estimate for the variation rate of the volume of trapped air in vessel 12 is about 30 ml per stroke.

The volume change of the trapped air in vessel 12 also depends on the expected static pressure at the output of pump 40. Higher static pressure corresponds to higher compression of the air. In various exemplary embodiments of the invention the volume of vessel 12 is designed and constructed to reduce all shocks of pressure in the liquid for an expected range of static pressure at the pump's outlet. This is advantageous over traditional systems that require an adjustment of the gas pressure in response to the pump's static pressure. According to some embodiments of the present invention the desired volume of captivated air is calculated for atmospheric pressure. The air is pressurized only when the pump applies the static head.

Ideally, the trapped air would reduce the pressure variations to almost zero. However, such ideal situation is rare, if at all attainable. Therefore, the volume change of the trapped air is calculated for a given tolerance Δp of pressure fluctuations in the flow line.

This example considers a pump in operation with an average static pressure of $p_s$. The volume of air in vessel 12 at this pressure is denoted $V_s$. The system pressure increases by the defined tolerance Δp. The air volume at a pressure of $p_s+\Delta p$ is denoted $V_c$. The difference between $V_s$ and $V_c$ is denoted $V_r$, and is used as an input volume parameter representing the amplitude of volumetric compression of the air while the pressure varies within the tolerance Δp. $V_r$ is given by a percentage of the stroke volume of the piston or plunger as derived from the duty cycle or velocity profile (see FIG. 5).

Using an ideal gas approximation for the air, and neglecting temperature variations during a single stroke of the pump, the following relations can thus be defined:

$$p*V=\text{constant} \quad \text{(EQ. 1)}$$

$$p_s*V_s=(p_s+\Delta p)*V_c \quad \text{(EQ. 2)}$$

$$V_c=V_s-V_r, \quad \text{(EQ. 3)}$$

leading to the following expression for $V_s$:

$$V_s=\frac{(p_s+\Delta p)*V_r}{\Delta p}. \quad \text{(EQ. 4)}$$

EQ. 4 provides the air volume at static pressure that can attenuate any pressure pulsation provided by a pump having a static pressure of $p_s$ to be within the predetermined tolerance Δp.

Using the aforementioned ideal gas approximation, EQ. 1, the pressure $p_s$ and volume $V_s$ satisfy:

$$p_s \cdot V_s=p_{atm} \cdot V_{atm}. \quad \text{(EQ. 5)}$$

EQ. 5 can then be used together with EQ. 4 to estimate the volume of the air at atmospheric pressure $V_{atm}$ for a given predetermined values of Δp and $V_r$:

$$V_{atm}=\frac{(p_s+\Delta p)\cdot V_r \cdot p_s}{\Delta p \cdot p_{atm}} \quad \text{(EQ. 6)}$$

Figure 6:
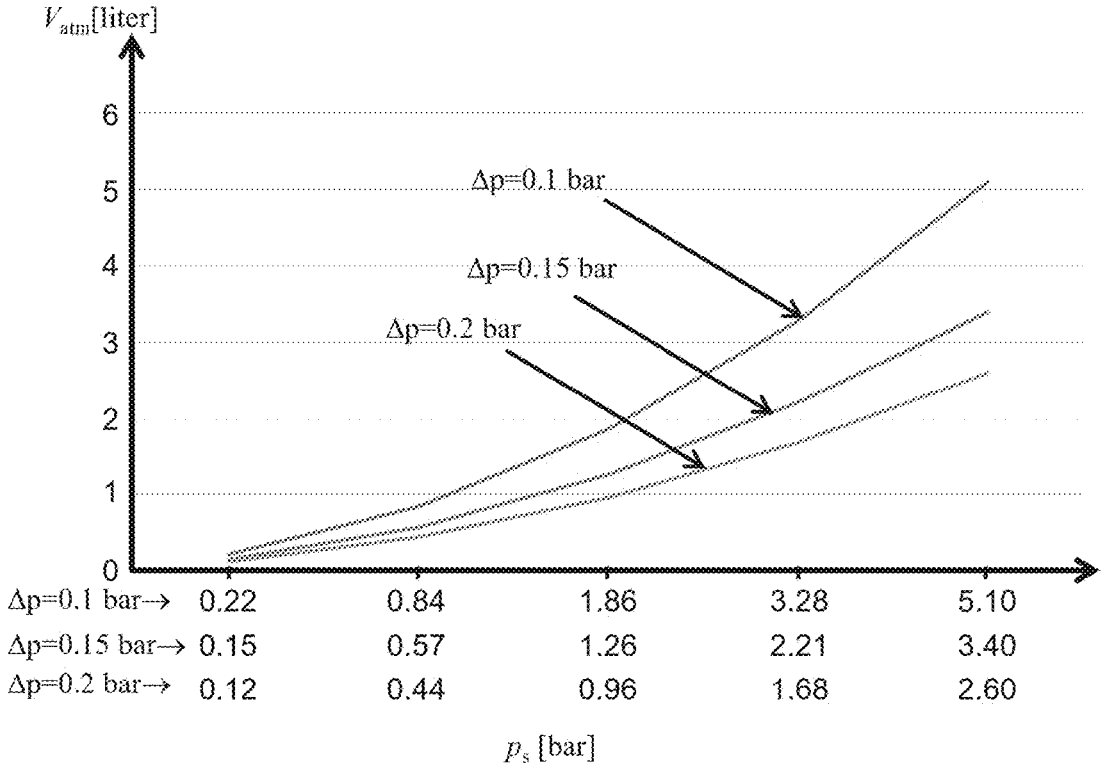
FIG. 6 shows air volume as a function of a static pressure at an outlet of a pump, as calculated according to some embodiments of the present invention.

As a representative example, consider a piston pump characterized by a stroke volume of 100 ml, and a predetermined volume parameter $V_r$ which is 20% of the pump's stoke volume, namely $V_r$=20 ml. FIG. 6 shows the calculated value of $V_{atm}$ as a function of $p_s$, for three different values of the pressure tolerance parameter Δp: 0.1 bar, 0.15 bar, and 0.2 bar.

Size of Drain Opening

When drain opening 44 is opened at all time, its size is optionally and preferably selected to reduce losses during the times at which the pump is operative (e.g., during day times) while allowing the vessel to be emptied through drain opening 44 during the times at which the pump is not operative (e.g., during night times). For example, when the pump is powered by solar energy pump, the size of drain opening 44 can be selected such that the maximal time period for draining the vessel is about ten hours (e.g., from about 1 hour to about 10 hours).

The flow losses in $m^3/s$ through drain opening 44 for at a constant or average static pressure, can be estimated as:

$$Q_l=C_{DC} \cdot A_o \cdot \sqrt{2 \cdot g \cdot h}, \quad \text{(EQ. 7)}$$

where $C_{DC}$ is the characteristic discharge coefficient through drain opening 44, $A_o$ is the cross-sectional area of drain opening 44, g the gravitational constant, and h the head of liquid that is in fluid communication with drain opening 44. For a circular shape of drain opening 44 with diameter $d_0$, $A_o$ is given by $$A_o=\frac{\pi d_o^2}{4} \quad \text{(EQ. 8)}$$

To calculate the draining time period $t_d$ a dynamic approach is employed, since the head and pressure change over time. Integrating and reorganizing EQ. 7, the following expression is obtained for the draining time period $t_d$ in seconds:

$$t_d = \frac{A_c}{C_{DC} * A_o} * \left(\sqrt{h_i} - \sqrt{h_f}\right) * \left(\sqrt{\frac{2}{g}}\right) \quad \text{(EQ. 9)}$$

where, $A_c$ is the cross-sectional area of the container being emptied (conduit 20, vessel 12, flow line 22), and $h_i$ and $h_f$ are upper and lower bounds for the head. Since draining is typically of the vessel 12, the conduit 20, and the flow line 22 which is connected to the conduit 20, the draining time period is the sum of the draining times of each container.

For example, assuming the same diameter for both conduit 20 and flow line 22, the combined draining time $t_{dc}$ is given by:

$$t_{dc} = \frac{\sqrt{\frac{2}{g}}}{C_{DC} * A_o} * \left(A_{cp} * \left(\sqrt{h_{ip}} - \sqrt{h_{fp}}\right) + A_{cd} * \left(\sqrt{h_{id}} - \sqrt{h_{fd}}\right)\right) \quad \text{(EQ. 10)}$$

where the subscript p relates to the combined head of the conduit 20 and the flow line 22 and the subscript d relates to the head of vessel 12.

As a numerical example, the values of the parameters in Table 1, below, are assumed.

TABLE 1

| | |
|---|---|
| $d_0$ | 0.6 mm |
| $A_0$ | $2.826 \times 10^{-7}$ $m^2$ |
| $C_{DC}$ | 0.8 |
| g | 9.81 $m/s^2$ |
| $A_{cp}$ | 0.00055 m2 |
| $A_{cd}$ | 0.005869 m2 |
| $h_{fp}$ | 0.72 m |
| $h_{ip}$ | 50 m |
| $h_{fd}$ | 0.001 m |
| $H_{id}$ | 0.71 m |

Substituting the values of the parameters listed in Table 1 into EQ. 10, the obtained draining time is $t_{dc} \approx 4.5$ hours. Subsisting the values of the parameters listed in Table 1 into EQ. 7, the obtained flow losses are $Q_l \approx 7.083 \times 10^{-6}$ $m^3/s$.

Passive Valve

Use of a passive valve, such as the valve illustrated in FIGS. 3A and 3B is advantageous since it allows using larger drain opening, since it is not necessary to apply considerations regarding flow losses. A larger drain opening saves on the draining time and also reduces the risk of clogging due to sediments, biological material, or other impurities in the water.

This Example assumes an operating range of the pump from about 10 to about 50 liters per minute, and a one-and-a-half-inch diameter at the valve's ports 66 and 68, so that the water velocities are from about 0.146 to about 0.73 m/s.

To assess if this velocity is sufficient to bias the member 70 against the opening 44, the forces acting upon member 70 are considered. The weight $F_W$ of member 70 is given by:

$$W = mg = \rho_d \cdot A \cdot h \cdot g \quad \text{(EQ. 11)}$$

where m is the mass of member 70, $\rho_d$ is the density of member 70, and A and h are the area and thickness of member 70, respectively. Taking buoyancy into account the following expression for the effective weight is obtained:

$$F_w = (\rho_d - \rho_w) \cdot A \cdot h \cdot g \quad \text{(EQ. 12)}$$

The drag force during the operation of the pump is given by:

$$F_D = C_D \cdot \rho_w \cdot A \cdot \frac{v^2}{2} \quad \text{(EQ. 13)}$$

where $C_D$ is the coefficient of the drag, and $\rho_w$ and v are the density and velocity of the water, respectively.

The equilibrium velocity at which the drag force $F_D$ balances the effective weight $F_W$ is, therefore:

$$v_{eq} = \sqrt{\frac{2 \cdot (\rho_d - \rho_w) \cdot h \cdot g}{C_D \cdot \rho_w}}, \quad \text{(EQ. 14)}$$

wherein any velocity above $v_{eq}$ is sufficient to bias member 70 against opening 44.

As a numerical example, the values of the parameters in Table 2, below, are assumed. Substituting those values into EQ. 14, an equilibrium velocity of about 0.15 m/s is obtained. It is appreciated that the value of $v_{eq}$ can be reduced using a lower density material.

TABLE 2

| | |
|---|---|
| $\rho_w$ | 997 $kg/m^3$ |
| $\rho_d$ | 1410 $kg/m^3$ |
| g | 9.81 $m/s^2$ |
| h | 0.003 m |
| $C_D$ | 1.1 |

Example 2

Experimental Results

Experiments were conducted using a prototype system as illustrated in FIG. 1B. The volume of the vessel 12 was 3 liters, and the pump was a piston pump. The pressure generated by the pump was adjusted by a pressure regulator at the end of the flow line 22. The speed of the piston was measured by the controller of the pump. In this experiment no drain opening was employed.

Figure 7A:
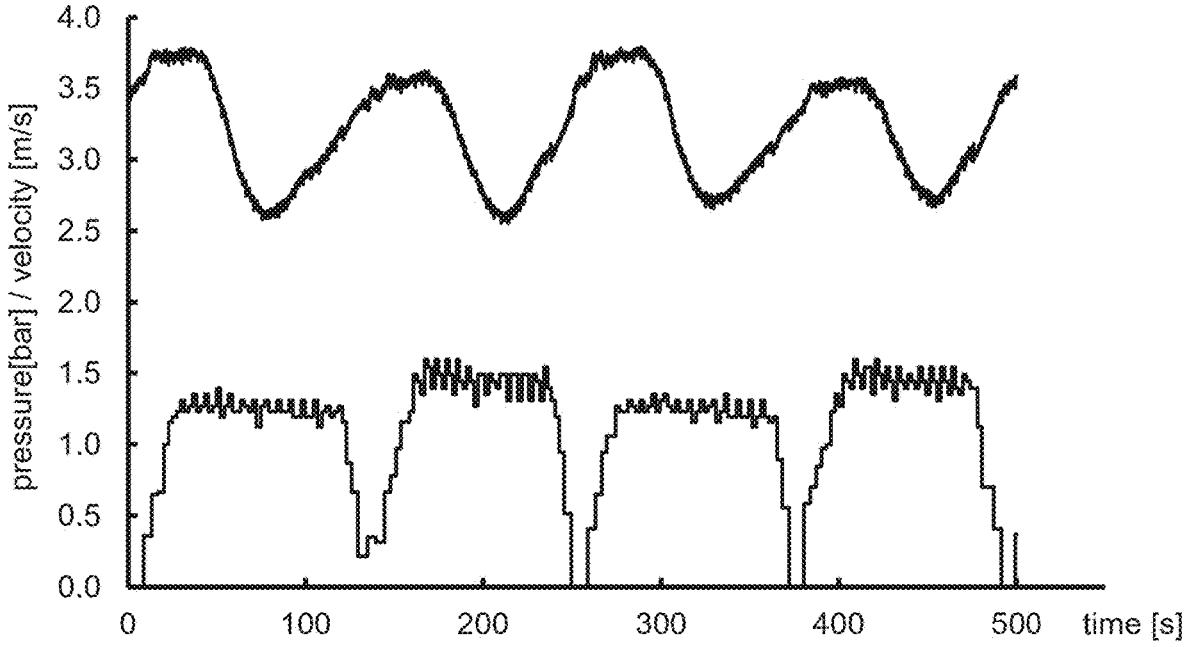
FIGS. 7A-B show results of experiments performed according to some embodiments of the present invention, where
Figure 7B:
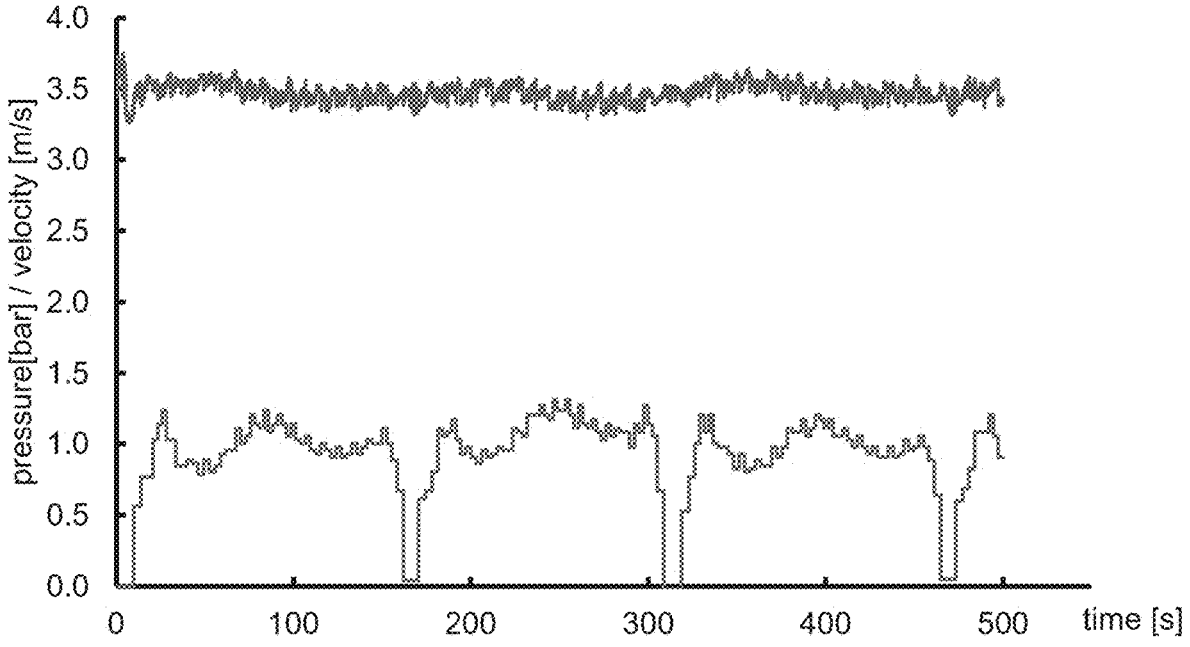

The results are shown in FIGS. 7A and 7B, where FIG. 7A shows the pressure (upper line) and the velocity (lower line) at the outlet of the pump, without pulsation attenuation, and FIG. 7B shows the pressure and the velocity at the outlet of the pump, with pulsation attenuation using the prototype system.

As shown, the pressure at the outlet of the pump is oscillatory, and the system of the present embodiments successfully stabilizes the pressure, hence attenuates the pressure pulsation.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

It is the intent of the applicant(s) that all publications, patents and patent applications referred to in this specification are to be incorporated in their entirety by reference into the specification, as if each individual publication, patent or patent application was specifically and individually noted when referenced that it is to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A method of attenuating pressure pulsations, comprising:

pumping liquid by a pump through an outlet of said pump into a liquid inlet, formed in a vessel of system for attenuating pressure pulsations and being connected to said outlet, wherein said system comprising:

a conduit in fluid communication with a lower part of said vessel, said conduit sealingly passing through a top surface of said vessel to feed a flow line outside said vessel with said liquid, wherein said liquid inlet is constituted to receive said liquid from said pump in a manner that said liquid enters both said vessel and said conduit, and creates an air-liquid interface in said vessel, by trapping in an upper part of said vessel air that attenuates pressure pulsations generated by said pump;

at least one drain opening constituted to drain said liquid out of said vessel and to allow air to fill at least said upper portion of said vessel; and a passive valve at said at least one drain opening, constituted to assume an opened state when said pump is not in operation, and a closed state when said pump is in operation; and temporarily ceasing said pumping to ensure opening of said passive valve, to drain out of said vessel through said at least one drain opening, and to allow air to fill at least said upper part of said vessel.

2. The method according to claim 1, wherein said pumping is directly into said conduit, and wherein said conduit has an opening at a lower part of said vessel for releasing said liquid to said lower part.

3. The method according to claim 1, wherein said pumping is directly into said vessel, and wherein said conduit has an inlet at a lower part of said vessel for receiving said liquid from said lower part and directing said liquid to said flow line.

4. The method according to claim 1, wherein said at least one drain opening is formed on an encapsulation of said pump, and said liquid is drained through said drain opening on said encapsulation.

5. The method of claim 1, wherein said at least one drain opening is on a valve device connected between said vessel and said pump.

6. The method of claim 5, wherein said valve device comprises:

a valve body formed with said drain opening;

a peripheral sealing member positioned within said valve body and being movable towards and away from said drain opening; and two liquid ports formed at opposite sides of said valve body, and being sealingly connectable to liquid conduits;

wherein said peripheral sealing member is positioned and configured such that inflow of liquid through said first port biases said sealing member against said drain opening, and inflow of liquid through said first port releases said sealing member from said drain opening.

7. A pump system, comprising:

a pump; and a system for attenuating pressure pulsations, comprising:

a vessel having a top surface, an upper part and a lower part;

a conduit in fluid communication with said lower part, said conduit sealingly passing through said top surface to feed a flow line outside said vessel with liquid;

a liquid inlet formed in said vessel and being connected to an outlet of said pump, for receiving said liquid from said pump in a manner that said liquid enters both said vessel and said conduit, and creates an air-liquid interface in said vessel, by trapping in said upper part air that attenuates pressure pulsations generated by said pump;

at least one drain opening constituted to drain said liquid out of said vessel and to allow air to fill at least said upper part of said vessel; and a passive valve at said at least one drain opening, constituted to assume an opened state when said pump is not in operation, and a closed state when said pump is in operation.

8. The system according to claim 7, wherein said conduit sealingly passes through said liquid inlet to connect directly to an outlet of said pump, and wherein said conduit has an opening at a lower part of said vessel for releasing said liquid to said lower part.

9. The system according to claim 7, wherein said conduit is disconnected from said liquid inlet of said vessel, and comprises a conduit inlet at said lower part for receiving said liquid from said lower part and directing said liquid to said flow line.

10. The system according to claim 7, wherein said at least one drain opening is formed in said vessel at said lower part.

11. The system according to claim 7, being devoid of any partition at said air-liquid interface.

12. The system according to claim 7, comprising a controller for temporarily ceasing operation of said pump.

13. The system according to claim 7, wherein said at least one drain opening is formed on an encapsulation of said pump.

14. The system of claim 7, wherein said drain opening is on a valve device connected between said vessel and said pump.

15. The system of claim 14, wherein said valve device comprises:

a valve body formed with said drain opening;

a peripheral sealing member positioned within said valve body and being movable towards and away from said drain opening; and two liquid ports formed at opposite sides of said valve body, and being sealingly connectable to liquid conduits;

wherein said peripheral sealing member is positioned and configured such that inflow of liquid through said first port biases said sealing member against said drain opening, and inflow of liquid through said first port releases said sealing member from said drain opening.

* * * * *